US007317881B2

(12) United States Patent
Hayashi

(10) Patent No.: US 7,317,881 B2
(45) Date of Patent: Jan. 8, 2008

(54) IMAGE HEATING APPARATUS

(75) Inventor: Yasuhiro Hayashi, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/776,364

(22) Filed: Jul. 11, 2007

(65) Prior Publication Data

US 2007/0258725 A1 Nov. 8, 2007

Related U.S. Application Data

(62) Division of application No. 11/141,323, filed on Jun. 1, 2005, now Pat. No. 7,263,306.

(30) Foreign Application Priority Data

Jun. 7, 2004 (JP) ..... 2004-168563

(51) Int. Cl.
*G03G 15/20* (2006.01)

(52) U.S. Cl. ..... 399/70; 399/341

(58) Field of Classification Search ..... 399/67, 399/70, 341

See application file for complete search history.

(56) References Cited

U.S. PATENT DOCUMENTS

| | | | | |
|---|---|---|---|---|
| 6,278,852 | B1 | 8/2001 | Hayashi | 399/88 |
| 6,349,187 | B2 | 2/2002 | Hayashi | 399/88 |
| 6,512,914 | B2 | 1/2003 | Kabashima | 399/341 |
| 6,691,399 | B1 | 2/2004 | Hayashi et al. | 29/605 |
| 2002/0098022 | A1 | 7/2002 | Kabashima | 399/341 |
| 2003/0180063 | A1 * | 9/2003 | Kanesawa et al. | 399/69 |
| 2004/0086308 | A1 * | 5/2004 | Kobayashi et al. | 399/341 |
| 2005/0031364 | A1 | 2/2005 | Hayashi | 399/69 |
| 2006/0210288 | A1 | 9/2006 | Haysahi et al. | 399/33 |
| 2007/0140717 | A1 | 6/2007 | Hayashi et al. | 399/69 |

FOREIGN PATENT DOCUMENTS

| | | |
|---|---|---|
| JP | 4-245275 | 9/1992 |
| JP | 2000-221820 | 8/2000 |
| JP | 2000-221821 | 8/2000 |
| JP | 2002-214948 | 7/2002 |
| JP | 2002-365967 | 12/2002 |

* cited by examiner

*Primary Examiner*—David M. Gray
*Assistant Examiner*—Joseph S. Wong
(74) *Attorney, Agent, or Firm*—Fitzpatrick, Cella, Harper & Scinto

(57) ABSTRACT

An image heating apparatus having a first fixing device for heating an image on a recording material, and a second fixing device for heating the image on the recording material heated by the first fixing device, wherein at the start of an image heating process, the preparatory operation of the first fixing device is started earlier than the preparatory operation of the second fixing device.

2 Claims, 7 Drawing Sheets

IMAGE HEATING APPARATUS

CROSS-REFERENCE TO RELATED APPLICATION

This application is a divisional of application Ser. No. 11/141,323, filed Jun. 1, 2005 now U.S. Pat. No. 7,263,306.

BACKGROUND OF THE INVENTION

1. Field of the Invention

The invention relates to an image heating apparatus for heating an image. This image heating apparatus is for use in a copying machine, a printer, a facsimile apparatus or the like adopting an electrophotographic process or an electrostatic recording process.

2. Description of Related Art

Numerous full-color image forming apparatuses such as printers and copying machines using the electrophotographic technique have been put into production.

The performance required of the full-color image forming apparatuses in recent years includes particularly the capability of forming images on various recording materials, a high speed and a high quality of image.

In forming images on various recording materials, it is important for a fixing device to always give an optimum amount of heat to a recording material and a toner. It is because by giving an optimum amount of heat, it is possible to secure sufficient fixing strength and obtain suitable image gloss.

For example, when a thick recording material is used, the thick recording material requires a greater amount of heat than ordinary recording materials to heat and fuse a toner image thereon and fix the toner image, because the thick recording material has a large heat capacity. Accordingly, when the thick recording material is used, a countermeasure is taken by setting a fixing temperature to high level or slowing down a fixing speed to thereby lengthen a fixing time.

However, in the former case where the fixing temperature is set to a high level, if the temperature is made too high, particularly when an image is to be formed on coat paper of low air permeability, there will arise the problem that moisture in the coat paper evaporates at a stroke and becomes vapor, and unevenness forms on a coating layer on the surface of the coat paper and disturbs the image. Also, there are many evils including the accelerated thermal deterioration of a fixing member and members around it and therefore, there has heretofore been adopted the latter countermeasure of slowing down the fixing speed to thereby lengthen the fixing time.

So, there has been proposed an image forming apparatus provided with a plurality of fixing devices so that a fixing process can be well carried out on various recording materials without the fixing speed being lowered (Japanese Patent Application Laid-open No. 2000-221821 and Japanese Patent Application Laid-open No. 2002-214948 (corresponding U.S. Pat. No. 6,512,914)).

However, in such an image forming apparatus provided with a plurality of fixing devices, if the rising operations (preparatory operations)/falling operations (preparatory operations) of the respective fixing devices are performed at the same timing at the start/end of the fixing process, there has been the possibility that it leads to the reduced lives of the fixing devices.

SUMMARY OF THE INVENTION

It is an object of the present invention to provide an image heating apparatus which can achieve a longer life.

It is also an object of the present invention to provide an image heating apparatus having first image heating means for heating an image on a recording material, and second image heating means for heating the image on the recording material heated by the first image heating means, wherein at the start of an image heating process, the preparatory operation of the first image heating means is started earlier than the preparatory operation of the second image heating means.

It is a further object of the present invention to provide an image heating apparatus having first image heating means for heating an image on a recording material, and second image heating means for heating the image on the recording material heated by the first image heating means, wherein at the end of an image heating process, the ending operation of the first image heating means is started earlier than the ending operation of the second image heating means.

Further objects of the present invention will become apparent from the following detailed description when read with reference to the accompanying drawings.

BRIEF DESCRIPTION OF THE DRAWINGS

FIG. 6A shows a state during the fixing operation, and FIG. 6B shows a state during the standby.

DETAILED DESCRIPTION OF THE PREFERRED EMBODIMENTS

The present invention will hereinafter be described more specifically with respect to the embodiments thereof. These embodiments are the best embodiments of the present invention, but the present invention is not restricted to these embodiments.

Embodiment 1

Figure 1:
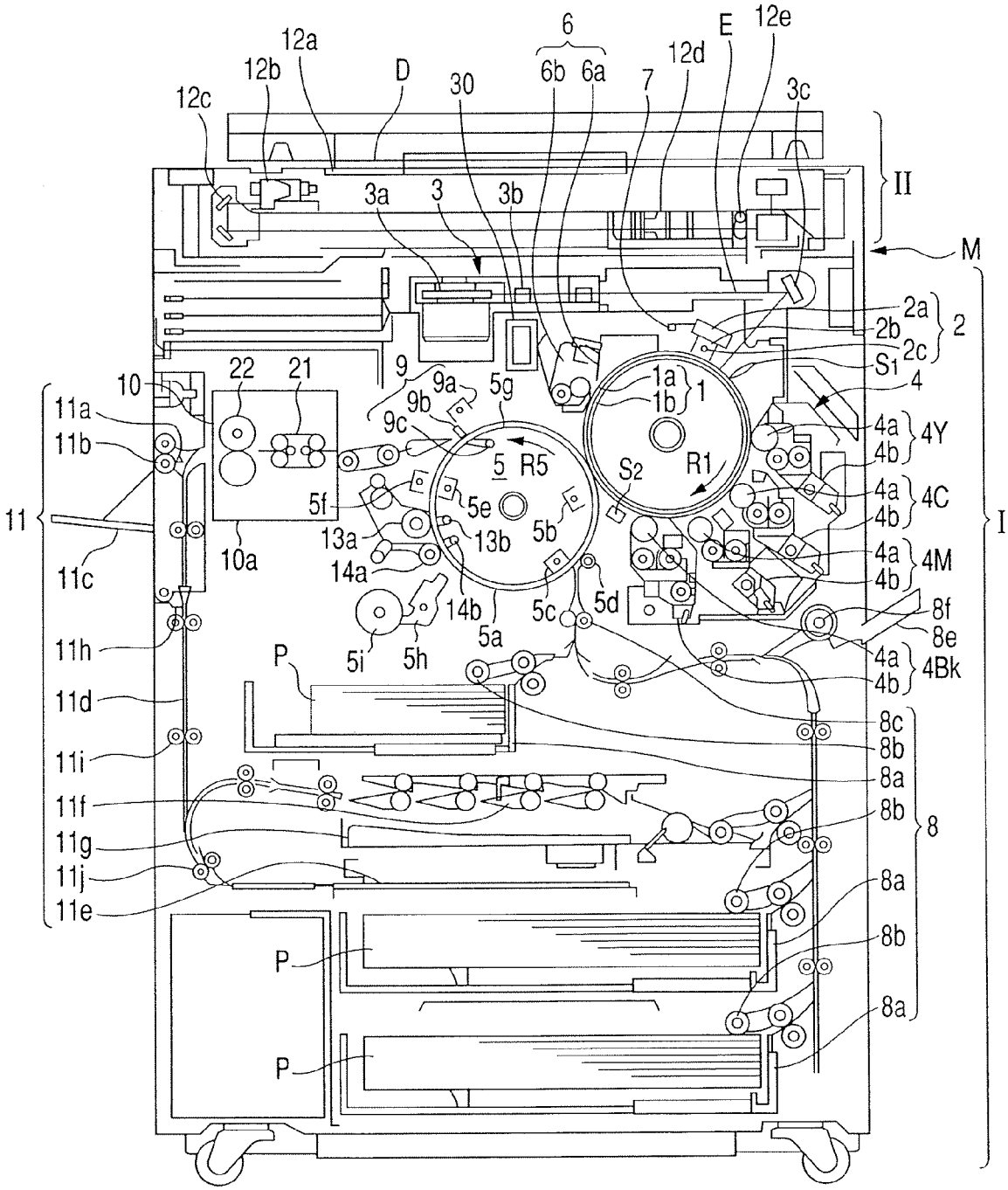
FIG. 1 is a longitudinal cross-sectional view schematically showing the construction of an image forming apparatus according to Embodiment 1.

FIG. 1 is a longitudinal cross-sectional view schematically showing the construction of an image forming apparatus according to this embodiment. This image forming apparatus is a four-color full-color printer of an electrophotographic type and a digital type (hereinafter referred to as the "image forming apparatus"). A recording material refers to a sheet-like member such as, for example, plain paper, coat paper or transparent film on which an image is formed, and as other appellations, mention may be made of transfer paper, recording paper, a sheet, a sheet material, etc.

The image forming apparatus shown in FIG. 1 is provided with a digital color image printer portion (hereinafter simply referred to as the "printer portion") I disposed in the lower portion of an image forming apparatus main body (hereinafter referred to as the "apparatus main body") M, and a digital color image reader portion (hereinafter simply referred to as the "reader portion") II disposed in the upper portion of the apparatus main body M, and forms an image on a recording material P in the printer portion I on the basis of the image of an original D read, for example, by the reader portion II.

The construction of the printer portion I will first be described, and then the construction of the reader portion II will be described.

(1) Printer Portion I

The printer portion I has a photosensitive drum 1 as an image bearing member rotatively driven in the direction indicated by the arrow R1. Around the photosensitive drum 1, there are disposed, substantially in succession along the rotation direction thereof, a primary charger (charging means) 2, an exposing apparatus (exposing means) 3, a developing apparatus (developing means) 4, a transferring apparatus (transferring means) 5, a cleaning apparatus (cleaning means) 6, a pre-exposure lamp (pre-exposing means) 7, etc. A paper feeding and conveying portion 8 for the recording material P is disposed below the transferring apparatus 5, i.e., in the lower half of the printer portion I, and further a separating apparatus (separating means) 9 is disposed in the upper portion of the transferring apparatus 5; and a fixing apparatus (fixing means) 10 as an image heating apparatus and a paper discharging portion 11 are disposed downstream of the separating apparatus 9 (downstream with respect to the conveying direction of the recording material P: in FIG. 1, at the left of the separating means 9).

The photosensitive drum 1 has a drum-shaped substrate 1*a* made of aluminum, and an organic photoconductive material (OPC) photosensitive layer 1*b* covering the surface (outer peripheral surface) thereof, and is designed to be rotatively driven at a predetermined process speed (peripheral speed) in the direction indicated by the arrow R1 by driving means (not shown).

The primary charger 2 is a corona charger having a shield 2*a* having an opening portion opposed to the photosensitive drum 1, a discharging wire 2*b* disposed in parallelism to the generatrix of the photosensitive drum 1 inside the shield 2*a*, and a grid 2*c* disposed in the opening portion of the shield 2*a* for regulating charging potential. Also, the primary charger 2 is adapted to have a charging bias applied thereto by a voltage source (a charging bias applying voltage source, not shown) to thereby uniformly charge the surface of the photosensitive drum 1 to a predetermined polarity and predetermined potential.

The exposing apparatus 3 has a laser output portion (not shown) emitting a laser beam on the basis of an image signal from the reader portion II which will be described later, a polygon mirror 3*a* for reflecting the laser beam, a lens 3*b* and a mirror 3*c*. This exposing apparatus 3 is designed to irradiate the surface of the photosensitive drum 1 with this laser beam to thereby expose the surface of the photosensitive drum 1 after uniformly charged, and eliminate the charges of the exposed portion and form an electrostatic latent image. In the present embodiment, the electrostatic latent image formed on the surface of the photosensitive drum 1 is such that by the laser beam color-resolved into four colors, i.e., yellow, cyan, magenta and black on the basis of the image of an original, electrostatic latent images corresponding to the respective colors are successively formed.

The developing apparatus 4 is provided with four developing devices in succession from the upstream side along the rotation direction (the direction indicated by the arrow R1) of the photosensitive drum 1, i.e., developing devices 4Y, 4C, 4M and 4Bk containing therein yellow, cyan, magenta and black toners, respectively, consisting of resin as a base material. Each of the developing devices 4Y, 4C, 4M and 4Bk has a developing sleeve 4*a* for causing the toner to adhere to the electrostatic latent image formed on the surface of the photosensitive drum 1, and design is made such that a developing device of a color for use for the development of the electrostatic latent image on the photosensitive drum 1 is selectively disposed at a developing position proximate to the surface of the photosensitive drum 1 by an eccentric cam 4*b*, and causes the toner to adhere to the electrostatic latent image through the developing sleeve 4*a* to thereby form a toner image (visible image) as a visualized image. Design is made such that the developing devices of the other three colors than the developing device used for development are retracted from the developing position.

The transferring apparatus 5 has a transfer drum (recording material bearing member) 5*a* bearing the recording material P on the surface thereof, a transfer charger 5*b* for transferring the toner images on the photosensitive drum 1 to the recording material P, an attracting charger 5*c* for causing the recording material P to be attracted to the transfer drum 5*a* and an attracting roller 5*d* opposed thereto, an inner charger 5*e* and an outer charger 5*f*, and a recording material bearing sheet 5*g* formed of a dielectric material is cylindrically and integrally extended in the peripheral opening area of the transfer drum 5*a* journalled so as to be rotatively driven in the direction indicated by the arrow R. As the recording material bearing sheet 5*g*, use is made of a dielectric material sheet such as polycarbonate film. Also, obliquely below the transfer drum 5*a* in FIG. 1, there are disposed a cam 5*i* and a cam follower (contacting and separating member) 5*h* for contacting and separating the transfer drum 5*a* with and from the photosensitive drum 1, and these are designed to separate the transfer drum 5*a* from the surface of the photosensitive drum 1 except for the times when the toner images on the photosensitive drum are transferred to the recording material P on the transfer drum 5*a*. This transferring apparatus 5 is designed to attract and bear the recording material P to and on the surface of the transfer drum 5*a*, and separate the recording material P from the transfer drum 5*a* after the toner image have been transferred to the recording material P.

The cleaning apparatus 6 is provided with a cleaning blade 6*a* for scraping off toners (residual toners) not transferred to the recording material P but residual on the surface of the photosensitive drum 1, and a cleaning container 6*b* for collecting the scraped-off toners.

The pre-exposure lamp 7 is disposed adjacent to the upstream side of the primary charger 2 along the rotation direction of the photosensitive drum 1, and is adapted to eliminate unnecessary charges on the surface of the photosensitive drum 1 cleaned by the cleaning apparatus 6.

The paper feeding and conveying portion 8 has a plurality of paper supplying cassettes 8*a* stacking and containing recording materials P of different sizes therein, a paper feeding roller 8*b* for feeding the recording materials P in the paper supplying cassettes 8*a*, a number of conveying rollers and registration rollers 8*c*. This paper feeding and conveying portion 8 is adapted to supply recording materials P of a predetermined size to the transfer drum 5*a*. Also, a manually feeding tray 8*e* is provided on the right side (as viewed in FIG. 1) of the apparatus main body M. The recording materials P set on this manually feeding tray 8*e* may be fed toward the registration rollers 8*c* by a paper feeding roller 8*f*.

The separating apparatus 9 has a separation charger 9*a*, a separating pawl 9*b*, a separating pushup runner 9*c*, etc. and serves to separate the recording material P after toner image transfer from the transfer drum 5*a*.

The fixing apparatus 10 as an image heating apparatus has, in a frame member 10*a*, a first fixing device 21 as first image heating means and a second fixing device 22 as second image heating means disposed downstream of the first fixing device 21 with respect to the conveying direction of the recording material. This fixing apparatus 10 will be described later in detail.

The paper discharging portion 11 has a conveying path switching guide 11*a* disposed downstream of the fixing apparatus 10 along the conveying direction of the recording material P, discharging rollers 11*b*, a paper discharging tray 11*c*, etc. Also, below the conveying path switching guide 11*a*, there are disposed a conveying vertical path 11*d* for effecting image formation on both sides of a recording material P, a reversing path 11*e*, a stacking member 11*f*, an intermediate tray 11*g*, conveying rollers 11*h*, 11*i*, reversing rollers 11*j*, etc.

Further, between the primary charger 2 and the developing apparatus 4 around the photosensitive drum 1, there is disposed a potential sensor $S_1$ for detecting the charged potential of the surface of the photosensitive drum 1, and between the developing apparatus 4 and the transfer drum 5*a*, there is disposed a density sensor $S_2$ for detecting the density of the toner images on the photosensitive drum 1.

(2) Reader Portion II

Subsequently, the reader portion II will be described. The reader portion II disposed above the printer portion I has an original glass stand 12*a* for placing the original D thereon, an exposure lamp 12*b* for exposing and scanning the image surface of the original D while being moved, a plurality of mirrors 12*c* for further reflecting reflected light from the original D, a lens 12*d* for condensing the reflected light, and a full-color sensor 12*e* for forming a color-resolved image signal on the basis of the light from the lens 12*d*. This color-resolved image signal is adapted to be subjected to processing by a video processing unit (not shown) via an amplifying circuit (not shown), and be delivered to the above-described printer portion I.

(3) Image Forming Operation of the Image Forming Apparatus

The image forming operation of the image forming apparatus of the above-described construction will now be briefly described with some description of the construction added thereto. The following description is an example in which a full-color image of four colors is formed in the order of yellow, cyan, magenta and black.

The image of the original D placed on the original glass stand 12*a* of the reader portion II is irradiated by the exposure lamp 12*b*, and is color-resolved, and the yellow image is first read by the full-color sensor 12*e*, is subjected to predetermined processing and is sent as an image signal to the printer portion I.

On the other hand, in the printer portion I, the photosensitive drum 1 is rotatively driven in the direction indicated by the arrow R1, and the surface of the photosensitive drum 1 is uniformly charged to a predetermined polarity and predetermined potential by the primary charger 2.

On the basis of the image signal sent from the above-described reader portion II, a laser beam is emitted from the laser output portion of the exposing apparatus 3, and the charged surface of the photosensitive drum 1 is exposed to an optical image E through the intermediary of the polygon mirror 3*a*, etc.

Charges are eliminated from that portion of the surface of the photosensitive drum 1 which has been subjected to the exposure, whereby an electrostatic image corresponding to yellow is formed thereon.

In the developing apparatus 4, the yellow developing device 4Y is disposed at a predetermined developing position, and the other developing devices 4C, 4M and 4Bk are retracted from the developing position. The yellow toner is caused to adhere to the electrostatic latent image on the photosensitive drum 1 by the developing device 4Y, whereby the electrostatic latent image is visualized and becomes a toner image.

This yellow toner image on the photosensitive drum 1 is transferred to the recording material P borne on the transfer drum 5*a*.

This recording material P is a recording material P of a size suited for the original image which has been supplied from a predetermined paper supplying cassette 8*a* to the transfer drum 5*a* through the paper feeding roller 8*b*, the conveying rollers and the registration rollers 8*c* at predetermined timing. The recording material P supplied in this manner is attracted so as to twine around the surface of the transfer drum 5*a* and is rotated in the direction indicated by the arrow R5, and the yellow toner image on the photosensitive drum 1 is transferred thereto by the transfer charger 5*b*.

On the other hand, a residual toner is removed from the surface of the photosensitive drum 1 after the transfer of the toner image by the cleaning apparatus 6 and further, unnecessary charges are eliminated therefrom by the pre-exposure lamp 7, and the photosensitive drum 1 is used for the next image formation beginning with the primary charger 2.

The above-described processes from the reading of the original image by the reader portion II to the transfer of the toner image on the transfer drum 5*a* to the recording material P and further, the cleaning and charge elimination of the photosensitive drum 1 are likewise carried out for the other colors than yellow, i.e., cyan, magenta and black. As a result, a full-color image of four colors is formed on the recording material P on the transfer drum 5*a*.

The recording material P to which the toner image of four colors has been transferred is separated from the transfer drum 5*a* by the separation charger 9*a*, the separating pawl 9*b*, etc., and is conveyed to the fixing apparatus 10 with the unfixed toner image borne on the surface thereof.

The toner image on the recording material P is heated and pressurized in the fixing apparatus 10 and is fixed on the surface of the recording material.

The recording material P after the fixing is discharged onto the paper discharging tray 11*c* by the discharging rollers 11*b*.

When images are to be formed on the both sides of the recording material P, the conveying path switching guide 11*a* is driven, whereby the recording material P after the fixing is once directed to the reversing path 11*e* via the conveying vertical path 11*d*. Thereafter, by the reverse rotation of the reversing rollers 11*j*, the recording material P is caused to leave with its trailing edge when fed in as the head in a direction opposite to the direction in which it was fed in, and is contained in the intermediate tray 11*g*. By the above-described image forming process, a full-color image is formed on the other side of the recording material P. The toner image is then fixed on this other side of the recording material P, whereafter the recording material P is discharged onto the paper discharging tray 11*c*.

On the transfer drum 5*a* after the separation of the recording material P, in order to prevent the scattering and adherence of power onto the recording material bearing sheet 5*g* and the adherence or the like of oil on the recording material P, cleaning is effected by a fur brush 13*a* and a back-up brush 13*b* opposed to each other, and an oil removing roller 14*a* and a back-up brush 14*b* opposed to each other, with the recording material bearing sheet 5*g* interposed therebetween. Such cleaning is effected before or after image formation, and may be effected at any time when jam has occurred.

(4) Fixing Apparatus 10

Figure 2:
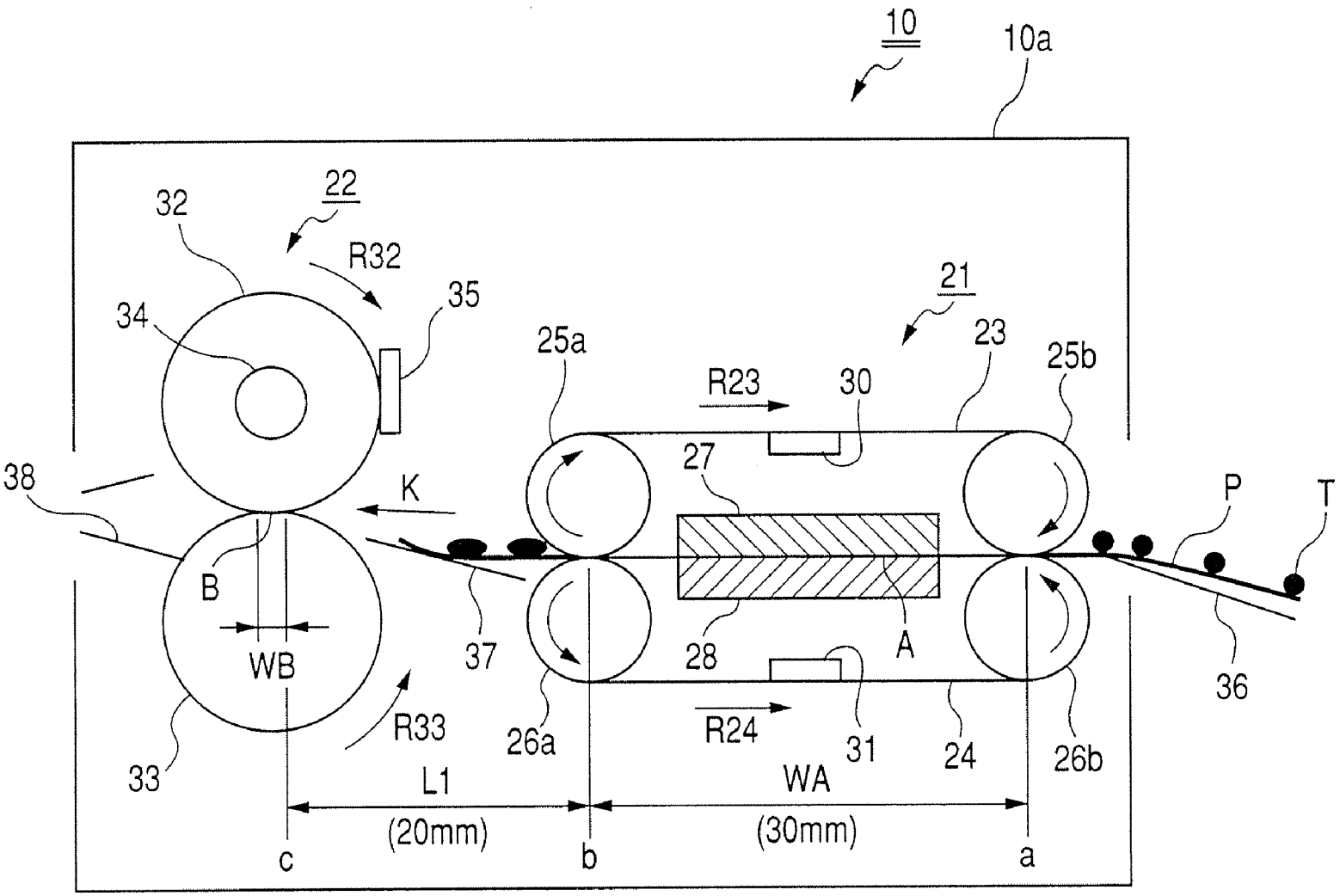
FIG. 2 is an enlarged longitudinal cross-sectional view (during the fixing operation) of a fixing apparatus.

FIG. 2 is an enlarged view of the fixing apparatus 10 as the image heating apparatus in FIG. 1. This fixing apparatus 10 has a frame member 10*a*, and inside this frame member 10*a*, there are disposed two fixing devices 21 and 22 along the conveying direction (the direction indicated by the arrow K) of the recording material P. In the following, the first fixing device 21 disposed upstream with respect to the conveying direction of the recording material will be referred to as the upstream fixing device, and the second fixing device 22 disposed downstream will be referred to as the downstream fixing device.

1) Upstream Fixing Device 21 (First Image Heating Means)

The upstream fixing device 21 has a fixing belt 23 (a first rotary member) as a heating member, and has a pressure belt 24 (a second rotary member) as a pressure member.

The fixing belt 23 functions as a fixing member contacting with the image on the recording material to thereby fix the image on the recording material. This fixing belt 23 is comprised of a belt made of nickel having a circumferential length of about 94 mm and a thickness of 50 μm, silicone rubber as an elastic layer provided to a thickness of 500 μm on the outer periphery of the belt, and further a PFA tube having a thickness of 30 μm provided as a mold releasing layer on the surface thereof.

The pressure belt 24 is a belt of a substantially similar construction.

The fixing belt 23 is passed over two belt rotary shafts 25*a* and 25*b*, and the pressure belt 24 is passed over two belt rotary shafts 26*a* and 26*b*.

The fixing belt 23 and the pressure belt 24 are designed to be rotatable in the direction indicated by the arrow R23 and the direction indicated by the arrow R24, respectively, without slipping relative to the belt rotary shafts 25*a*, 25*b* and 26*a*, 26*b*, respectively.

Each of the belt rotary shafts 25*a*, 25*b*, 26*a* and 26*b* is comprised of a substrate made of aluminum having its outer peripheral surface covered with a sponge of foamed silicone rubber for the adiabatic purpose. Also, the belt rotary shaft 25*a* and the belt rotary shaft 26*a* are pressurized with a total load of 5 kgf (49N). Likewise, the belt rotary shaft 25*b* and the belt rotary shaft 26*b* are pressurized with a total load of 5 kgf (49N).

An exciting coil (heat source) 27 as a belt heating source is disposed between the two belt rotary shafts 25*a* and 25*b* inside the fixing belt 23. Likewise, an exciting coil (heat source) 28 as a belt heating source is disposed between the two belt rotary shafts 26*a* and 26*b* inside the pressure belt 24.

These exciting coils 27 and 28 are molded from flat plate-shaped and insulative resin. These exiting coils 27 and 28 are mutually pressurized with a total load of 20 kgf (196N). Thereby, the width (the width in a direction along the conveying direction of the recording material P) WA of the pressure contact portion (the fixing nip portion, hereinafter referred to as the nip) A between the fixing belt 23 and the pressure belt 24 is about 30 mm and further, the total load between the fixing belt 23 and the pressure belt 24 is 30 kgf and therefore, the line pressure becomes about 1 kgf (9.8N)/mm.

Here, the line pressure is found by the total load (kgf) between the heating member and the pressure member the width (mm) of the total pressure contact portion between the heating member and the pressure member.

Any one of the above-described fixing belt 23, pressure belt 24, belt rotary shafts 25*a*, 25*b*, 26*a*, 26*b* and exciting coils 27, 28 is formed so that the length thereof along the passing width direction of the recording material P (the direction orthogonal to the conveying direction of the recording material P) may be greater than the passing width of a recording material P of a maximum passing width used for image formation.

A high-frequency current of 10-100 kHz is supplied to the above-described exciting coils 27 and 28, whereby the fixing belt 23 and the pressure belt 24 are induced to generate heat. Then, the fixing belt 23 and the pressure belt 24 are temperature-adjusted so as to maintain their respective predetermined target temperatures on the basis of detected values by sensors 30 and 31 for detecting the respective temperatures thereof.

The fixing belt 23 and the pressure belt 24 are rotatively driven by driving means at least during the execution of image formation, whereby they are rotated at a predetermined peripheral speed in the direction indicated by the arrow R23 and the direction indicated by the arrow R24, respectively. At that time, they are rotatively driven without wrinkles at substantially the same peripheral speed as the conveying speed of the recording material P bearing an unfixed toner image thereon which is conveyed from the image transferring portion side (the transfer drum 5*a* side). In the case of the present embodiment, they are designed to be rotated at a peripheral speed of 250 mm/sec. and be capable of fixing 60 sheets of full-color image of A4 size per minute.

In a state in which the fixing belt 23 and the pressure belt 24 have risen from a predetermined standby temperature to a predetermined fixing temperature and have been temperature-controlled, the recording material P is guided toward the nip A by a guide member 36 and is subjected to a fixing process. At that time, the recording material P is conveyed with its toner image bearing surface side remaining in close contact with the outer peripheral surface of the fixing belt 23, whereby heat and pressure are imparted from the fixing belt 23 and the pressure belt 24 to the recording material P and the unfixed toner image T is fixed on the surface of the recording material P (the first fixing process).

The recording material P passed through the nip A is separated from the outer peripheral surface of the fixing belt 23 at the recording material exit portion "b" of the nip A, and is guided and conveyed to the downstream fixing device 22 by a guide member 37.

The fixing belt 23 and the pressure belt 24 being rotated are pressurized with relatively light pressure and therefore, even if they are in their rotated state, their moving force in the width direction (the direction along the belt rotary shafts 25*a*, 25*b*, 26*a* and 26*b*) is small. That is, the force which tries to shift the fixing belt 23 and the pressure belt 24 in the width direction is small. Therefore, as means for regulating the movement of the belts in the width direction, it is sufficient to provide a flange member for simply receiving the end portion of the pressure belt 24, and this leads to the advantage that the construction of the upstream fixing device 21 can be simplified.

Besides this, there will be no problem if the construction is modified to a construction in which heat generating members are provided in the rotary shafts 25*a*, 25*b*, 26*a* and 26*b*.

2) Downstream Fixing Device 22 (Second Image Heating Means)

The downstream fixing device 22 has a fixing roller 32 (a third rotary member) as a heating member, and a pressure roller 33 (a fourth rotary member) as a pressure member.

The fixing roller 32 functions to heat and fix the image on the recording material. This fixing roller 32 is comprised of a cylindrical substrate made of iron and having an outer diameter of 30 mm and a thickness of 1 mm, and covered with silicone rubber as an elastic layer having a thickness of 1 mm, and a PFA tube having a thickness of 30 μm provided as a mold releasing layer on the surface layer.

The pressure roller 33 is also substantially similar in construction to the fixing roller 32.

The fixing roller 32 and the pressure roller 33 are pressurized with total pressure of 45 kgf (441N), and the width (the width in a direction along the conveying direction of the recording material P) WB of the pressure contact portion (the fixing nip portion, hereinafter referred to as the nip) B between the two is about 3 mm. Accordingly, the line pressure becomes about 15 kgf/mm (45 kgf/3 mm=15 kgf/mm).

A halogen heater (heat source) 34 as a heating source is disposed in the fixing roller 32. The halogen heater 34 is heat-adjusted so as to maintain a predetermined target temperature on the basis of a detected value by a temperature sensor 35 for detecting the temperature of the fixing roller 32.

Each of the fixing roller 32, the pressure roller 33 and the halogen heater 34 is designed to be longer than the maximum passing width of the recording material P.

The fixing roller 32 and the pressure roller 33 are rotatively driven in the direction indicated by the arrow R32 and the direction indicated by the arrow R33, respectively, at a predetermined peripheral speed, i.e., substantially the same peripheral speed as the recording material conveying speed (250 mm/sec.) of the upstream fixing device 21, by driving means at least during the execution of image formation).

In a state in which the fixing roller 32 has risen from a predetermined standby temperature to a predetermined fixing temperature and is temperature-controlled, the recording material P is guided toward the recording material entrance portion "c" of the nip B by a guide member 37. At that time, the recording material P subjected to the first fixing process by the upstream fixing device 21 is guided to the nip B so that the toner image bearing surface side thereof may contact with the fixing roller 32. Then, heat and pressure are imparted from the fixing roller 32 and the pressure roller 33 to the toner image on the recording material P, whereby the recording material P is subjected to the second heat-pressure fixing process. The recording material P passed through the nip B is separated from the outer peripheral surface of the fixing roller 32 and is guided and conveyed for discharge by a guide member 38.

In the present embodiment, the recording material conveying distance L1 from the recording material exit portion "b" of the nip A of the upstream fixing device 21 to the recording material entrance portion "c" of the nip of the downstream fixing device 22 is set to 20 mm.

3) Control System of the Upstream Fixing Device 21 and the Downstream Fixing Device 22

Figure 3:
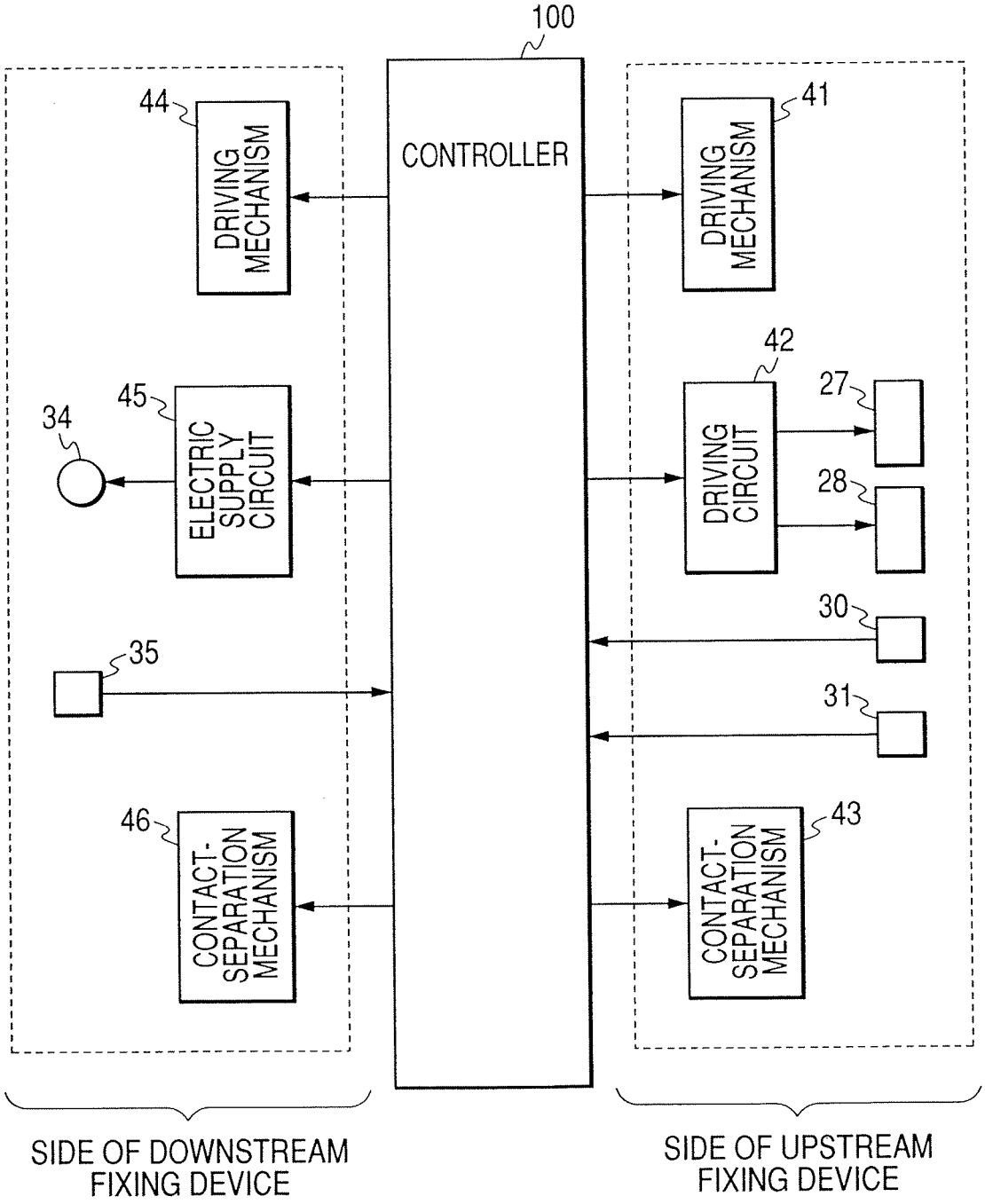
FIG. 3 is a block diagram of the control system of the fixing apparatus.

FIG. 3 is a block diagram of the control system of the upstream fixing device 21 and the downstream fixing device 22. The reference numeral 100 designates a controller (CPU) as the main controlling portion of the image forming apparatus.

The operations of the driving mechanism 41, exciting circuit 42 and contact-separation mechanism 43 of the upstream fixing device side and the operations of the driving means 44, electric supply circuit 45 and contact-separation mechanism 46 of the downstream fixing device side are sequence-controlled by the controller 100.

On the upstream fixing device side, the driving mechanism 41 is driving means for rotatively driving the fixing belt 23 and the pressure belt 24, and this driving mechanism 41 is controlled by the controller 100, and the fixing belt 23 and the pressure belt 24 are controlled into a rotated state and a stopped state. The exciting circuit 42 is a circuit for supplying a high-frequency current to the exciting coils 27 and 28 as belt heating sources.

The controller 100 controls the amount of supplied electric power from the exciting circuit 42 to the exciting coils 27 and 28 so that on the basis of the detected temperature information of the fixing belt 23 and the pressure belt 24 inputted from the temperature sensors 30 and 31, the temperatures of the fixing belt 23 and the pressure belt 24 may be maintained at predetermined target temperatures.

Figure 4:
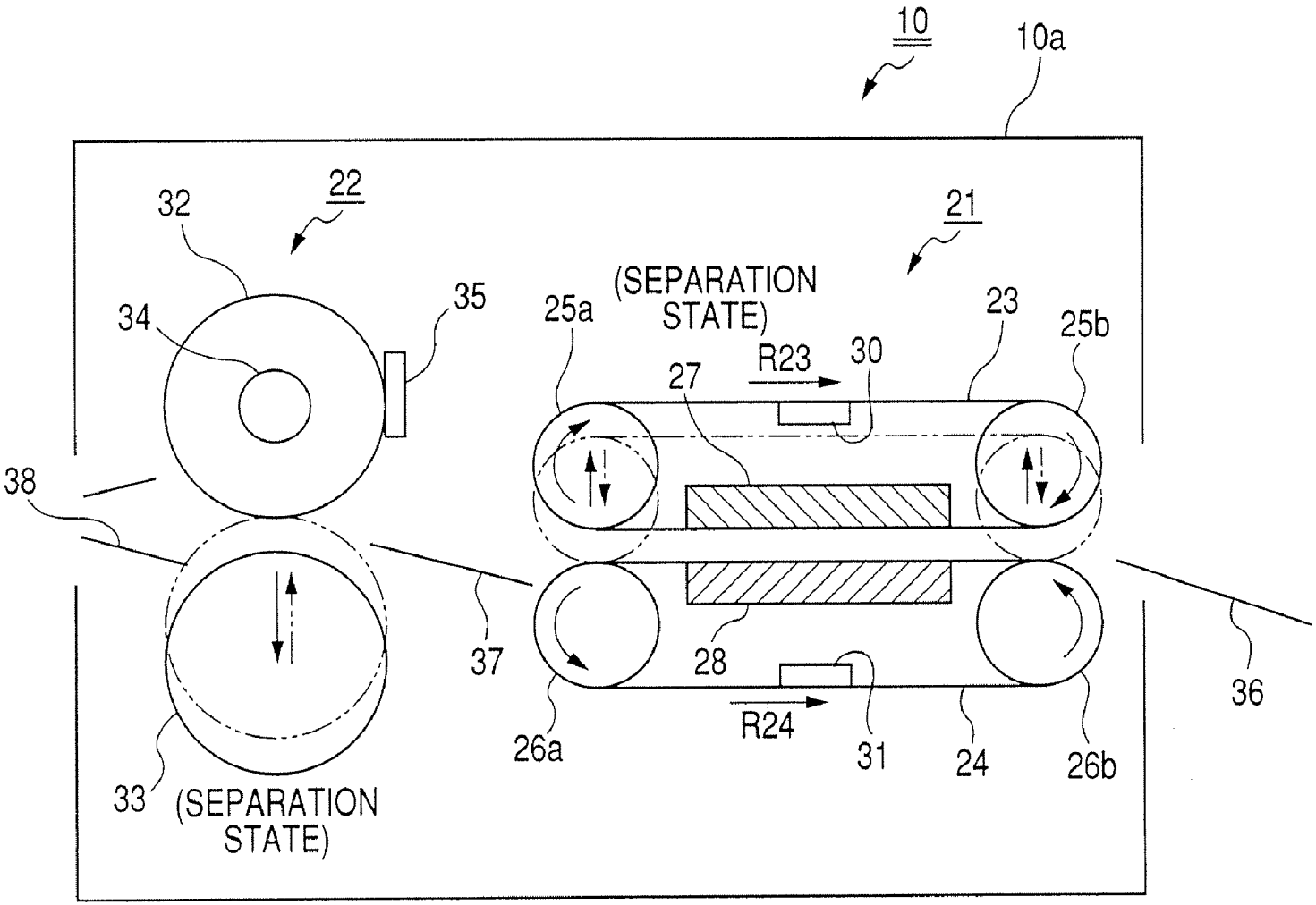
FIG. 4 is an enlarged longitudinal cross-sectional view (during the standby) of the fixing apparatus.

The contact-separation mechanism 46 is designed to be controlled by the controller 100, and is a mechanism for converting the fixing belt 23 into the "contact state" of FIG. 2 in which it has been brought into pressure contact with the pressure belt 24, and the separation state of FIG. 4 in which it has been upwardly separated from the pressure belt 24.

On the downstream fixing device side, the driving mechanism 44 is driving means for rotatively driving the fixing roller 32 and the pressure roller 33, and this driving mechanism 44 is controlled by the controller 100, and the fixing roller 32 and the pressure roller 33 are controlled into a rotated state and a stopped state.

The electric supply circuit 45 is a circuit for supplying electric power to the halogen heater 34 as the heating source of the fixing roller 32.

The controller 100 controls the amount of supplied electric power from the electric supply circuit 45 to the halogen heater 34 so that on the basis of the detected temperature information of the fixing roller 32 inputted from the temperature sensor 35, the temperature of the fixing roller 32 may maintain a predetermined target temperature.

The contact-separation mechanism 46 is designed to be controlled by the controller 100, and is a mechanism for converting the pressure roller 33 into the "contact state" of FIG. 2 in which it has been brought into predetermined pressure contact with the fixing roller 32, and the "separation state" of FIG. 4 in which it has been downwardly separated from the fixing roller 32.

Each of the driving mechanisms 41 and 44 is constituted by a timing belt mechanism, a gear train mechanism or the like which transmits the rotating force of a motor as a drive source to the fixing device through a clutch mechanism contact-separation-controlled by the controller 100.

Also, each of the contact-separation mechanisms 43 and 46 is constituted by a pressure mechanism including a pressure spring, and a cam mechanism, a solenoid mechanism or the like which releases a contact pressure state against the biasing force of the pressure spring.

4) Control of the Operations of the Upstream Fixing Device 21 and the Downstream Fixing Device 22

The fixing apparatus 10 in the present embodiment is such that the upstream fixing device 21 effects fixing at a relatively low temperature and light pressure and for a long time (the width WA of the nip A being wide), and the downstream fixing device 22 effects fixing at relatively high pressure and for a short time.

That is, the time required for the recording material P to pass through the nip A of the upstream fixing device 21 is made longer than the time required for the recording material P to pass through the nip B of the downstream fixing device 22, whereby a fixed image of low gloss can be obtained without the fixing temperature being heightened.

This is for the purpose of suppressing the gloss at the upstream fixing device 21 to a low level and making the gloss at the downstream fixing device 22 adjustable to desired gloss.

Accordingly, the gloss of the image fixed by the upstream fixing device 21 is made constant irrespective of the thickness and kind of the recording material, and environmental temperature and environmental humidity. The gloss of the image is adjusted by the temperature of the fixing roller 32 of the downstream fixing device 22. If at this time, the temperature of the fixing roller 32 is a high temperature, the gloss of the image can be made high.

Specifically, in a case where the recording material is plain paper, the target temperature of the fixing belt 23 and pressure belt 24 of the upstream fixing device 21 is 140° C. and the target temperature of the fixing roller 32 of the downstream fixing device 22 is 110° C., and the gloss by a gloss meter of a 60° method at this time is 10. When higher gloss has been set by an operator through a gloss setting portion (operating portion), if the target temperature is set to e.g. 180° C., gloss of 40 can be obtained.

Also, the target temperature of the fixing belt 23 and pressure belt 24 of the upstream fixing device 21 and the target temperature of the fixing roller 32 of the downstream fixing device 22 may be suitably changed in accordance with the kind of the recording material used.

When for example, thick paper is used, the target temperature of the fixing belt 23 and the pressure belt 24 may preferably be 150° C. higher by 20° C. than for plain paper. By doing so, it is possible according to the present embodiment to raise the temperature of the upstream fixing device 21 to thereby obtain an image of low gloss while securing a fixing property at a point of time whereat only the fixing by the upstream fixing device 21 has been finished, without slowing down the fixing speed in spite of thick paper although the fixing speed must be slowed down to maintain the fixing property.

Further, if the temperature of the fixing roller 32 when fixing is effected by the second fixing device 22 on the downstream side is controlled, the gloss can be controlled from a low level to a high level as desired.

When for example, thick paper is used, if the target temperature of the fixing belt 23 and pressure belt 24 of the upstream fixing device 21 is set to 150° and the target temperature of the fixing roller 32 of the downstream fixing device 22 is set to 100° C., gloss of 10 by a gloss meter of a 60° method can be obtained, and if the target temperature of the fixing roller 32 of the downstream fixing device 22 is set to 200° C., gloss of 40 can be obtained.

Thus, without productivity being lowered, images having various degrees of gloss can be obtained by the upstream fixing device 21 and the downstream fixing device 22. That is, an image conforming to the degree of gloss desired by the operator can be obtained without productivity being lowered.

Also, the temperature adjustment of the fixing roller 32 of the downstream fixing device 22 may be changed in accordance with the environmental temperature and environmental humidity. In such case, desired image gloss can be provided irrespective of the environmental temperature and humidity.

The control of the pressure force of the downstream fixing device 22 and the temperature of the fixing belt 23 and pressure belt 24 of the upstream fixing device 21 is not restricted to what has been described above, but may be suitably changed.

Also, in a case where coat paper of low air permeability or the like is used as the recording material P, if fixing is effected at a relatively high temperature, there will arise the problem that moisture in the coat paper is instantly gasified and the coating layer on the surface of the coat paper becomes uneven, but in the fixing apparatus 10 according to the present embodiment, it is possible to solve this problem. The upstream fixing device 21 is controlled at a relatively low temperature (in the present embodiment, 140° C.) and therefore, the coating layer of the coat paper can be prevented from being made uneven by water vapor. Because fixing was once effected by the upstream fixing device 21, the moisture in the paper has been greatly decreased immediately before the fixing by the downstream fixing device 22, and even if fixing is effected at a high temperature by the downstream fixing device 22, it is difficult for the unevenness of the coating layer to occur. Also, the upstream fixing device 21 is great in the width WA of the pressure contact portion A thereof and therefore, can heat the toner image on the recording material P for a long time though at a relatively low temperature and thus, can keep its fixing strength.

3-1) The Time when the Image Forming Operation is Started (the Time when the Image Heating Process is Started)

Figure 5:
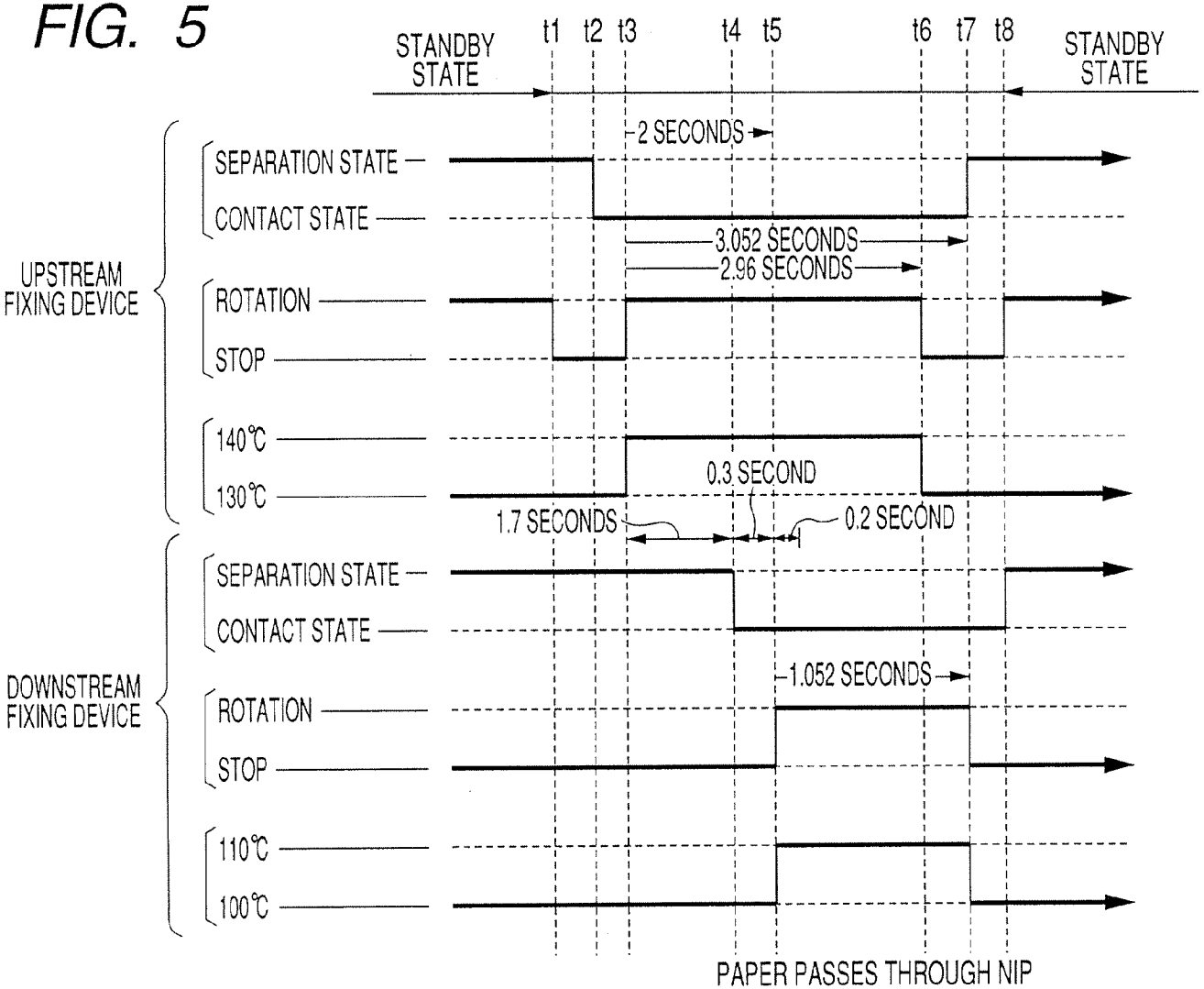
FIG. 5 is a timing chart of the fixing operation.

The operation of the fixing apparatus 10 when the image forming apparatus starts the image forming operation will now be described with reference to the typical view of FIG. 4 and the timing chart of FIG. 5. As will be described later, when starting the image forming operation, a preparatory operation (rising operation) is executed in the respective fixing devices. This preparatory operation includes the rotation starting operation, the pressure contact operation and the temperature raising operation from the standby temperature to the fixing temperature (target temperature changing operation) of the fixing device.

First, when the image forming apparatus is in its standby state, as shown in FIG. 4, the upstream fixing device 21 is in a state in which the fixing belt 23 and the pressure belt 24 are separated from each other. The downstream fixing device 22 is also in a state in which the fixing roller 32 and the pressure roller 33 are separated from each other.

In the upstream fixing device 21, when in a standby state in which it is waiting for the inputting of an image formation starting signal, temperature adjustment is effected on the basis of the detected values by the temperature sensors 30 and 31 so that the temperature of the fixing belt 23 and the pressure belt 24 may become a standby temperature, specifically, 130° C., lower than the fixing temperature.

At this time, the fixing belt 23 and the pressure belt 24 may be in rotation or stopped from rotating. Being in rotation is more preferable because the temperature distribution in the circumferential direction of each belt is uniformized and therefore the image gloss after fixing becomes uniform, but to curtail the electric power consumption in the fixing device 21, stopping the rotation is more preferable. Either can be suitably selected by the user. In the following, description will be made of the case where the belts are being rotated during the standby.

In the downstream fixing device 22, when waiting for the inputting of the image formation starting signal, temperature adjustment is effected on the basis of the detected value by the temperature sensor 35 so that the temperature of the fixing roller 32 may become a standby temperature, specifically 100° C., lower than the fixing temperature. At this time, the rotation of the fixing roller 32 is stopped.

In the case of a construction in which the fixing belt 23 and the pressure belt 24 are being rotated during standby at a point of time t1 whereat the image forming apparatus receives the image formation starting signal and starts the image forming operation, the rotation is once stopped.

Thereafter, the fixing belt 23 and the pressure belt 24 are quickly brought into contact with each other (a point of time t2).

In the meantime, temperature adjustment is always effected on the basis of the detected values by the temperature sensors 30 and 31 so that the temperature of the fixing belt 23 and the pressure belt 24 may become a standby temperature, specifically 130° C.

Then, at the same time as the rotation is started again at a point of time 3, the target temperature is raised to the fixing temperature, specifically 140° C.

Also, once stopping the rotation is for preventing the surfaces of the belts from being injured by a slight difference in rotational speed or the like if the fixing belt 23 and the pressure belt 24 are brought into contact with each other while being rotated.

In the present embodiment, the sequence is such that at a point of time t5 whereat 2 seconds has elapsed from the point of time t3 at which the upstream fixing device 21 has started to be rotated, the recording material P bearing the unfixed toner image T thereon arrives at the recording material entrance portion "a" of the nip A of the upstream fixing device 21.

On the other hand, the downstream fixing device 22 is such that at a point of time t4 after 1.7 second from the point of time t3 at which the upstream fixing device 21 has started to be rotated, the fixing roller 32 and the pressure roller 33 are brought into pressure contact with each other. Then, the fixing roller 32 and the pressure roller 33 start to be rotated at the point of time t5 after they have been brought into pressure contact with each other.

Simultaneously with the rotation, the target temperature of the fixing roller 32 is raised from the standby temperature to the fixing temperature, specifically, 110° C.

The required time from the point of time t4 till the point of time t5 is 0.3 second or so and the distance from the recording material exit portion "b" of the nip A of the upstream fixing device 21 to the recording material entrance portion "c" of the nip B of the downstream fixing device 22 is 20 mm and thus, after 0.2 second from after the downstream fixing device 22 has started to be rotated, the recording material P arrives at the recording material entrance portion "c" of the nip B of the downstream fixing device 22 ((30+20 mm)/250 mm/sec.=0.2 sec.).

3-2) The Time when the Image Forming Operation is Finished (the Time when the Image Heating Process is Finished)

Description will now be made of the time when the image forming apparatus finishes the image forming operation. As will be described later, when finishing the image forming operation, the finishing operation (the falling operation) is executed in the respective fixing devices. This finishing operation includes the rotation stopping operation and separating operation of the fixing devices, and the temperature lowering operation (target temperature changing operation) from the fixing temperature to the standby temperature.

The upstream fixing device 21 is quickly stopped from rotating at a point of time t6 immediately after the last recording material P in the image forming job has passed through the nip A. At the same time, the target temperature of the upstream fixing device 21 is lowered to 130° C. Then, at a point of time t7 after the rotation has been stopped, the fixing belt 23 and the pressure belt 24 are separated from each other. Thereafter, at a point of time t8, the fixing belt 23 and the pressure belt 24 start to be rotated while remaining separated from each other, and shift is made to the standby state.

The downstream fixing device 22 is quickly stopped from rotating at a point of time t7 after the trailing edge portion of the last recording material P in the image forming job has passed through the nip B. At the same time, the target temperature of the fixing roller 32 is lowered to 100° C. Thereafter, at a point of time t8, the fixing roller 32 and the pressure roller 33 are separated from each other, and shift is made to the standby state.

In the above-described example, the execution timing of each sequence is effected on the basis of the input timing of the image formation starting signal, but may be executed on the basis of the result of the detection by a sensor such as a photointerrupter for detecting the passage timing of the recording material. Specifically, a photointerrupter may be disposed on a recording material conveying path (paper conveying path) between the upstream fixing device 21 and the downstream fixing device 22 so as to detect the last recording material P passing through the recording material exit portion "b" of the nip A.

Description will now be made of the rotating time of the upstream fixing device 21 and the downstream fixing device 22 when in the above-described operation, an image is to be formed on a sheet of recording material P of A4 size (having a length of 210 mm in the conveying direction).

First, the upstream fixing device 21 starts to be rotated at the point of time t3, whereafter at the point of time t5 after the lapse of two seconds, the recording material P bearing the unfixed toner image T thereon arrives at the recording material entrance portion "a" of the nip A of the upstream fixing device 21, and the upstream fixing device 21 is stopped from rotating at the point of time t6 immediately after the recording material P has passed through the nip A and therefore, the rotating time is 2.96 seconds ((30 mm+210 mm)/250 mm/sec.+2 sec.).

Next, the downstream fixing device 22 starts to be rotated at the point of time +5 and after 0.2 second, the recording material P arrives at the recording material entrance portion "c" of the nip B of the downstream fixing device 22, and the downstream fixing device 22 is stopped from rotating at the point of time t7 immediately after the recording material P has passed through the nip B and therefore, the rotating time is 1.052 second ((3 mm+210 mm)/250 mm/sec.+0.2 sec.)

Assuming that the rotating operations of the upstream fixing device 21 and the downstream fixing device 22 are started and stopped at the same times, both of the rotating times of the upstream fixing device 21 and the downstream fixing device 22 are 3.052 seconds ((30+20+3+210 mm)/250 mm/sec.+2 sec.).

Thus, according to the present embodiment, the upstream fixing device 21 has had its rotating time shortened by 3%, and the downstream fixing device 22 has its rotating time shortened by 65.5%. The shortening of the rotating time means the extended life of the fixing device.

While in the present embodiment, the upstream fixing device 21 has been described as being of the belt fixing type and the downstream fixing device 22 has been described as being of the roller fixing type, the number of the fixing devices may be three or greater, and various fixing types may be used.

As has been described above, according to the present embodiment, at the start/end of an image formation, useless operations in the plurality of fixing devices can be decreased and therefore, it becomes possible to extend the lives of the fixing devices.

It also becomes possible to change the target temperature of the fixing devices at appropriate timing to thereby curtail the electric power consumption in the fixing devices.

Also, the upstream fixing device and the downstream fixing device can be restrained from being in pressure contact longer than necessary and therefore, the danger of the elastic portions of the upstream fixing device and the downstream fixing device being permanently deformed can be decreased as far as possible. That is, it becomes possible to achieve the longer lives of the two fixing devices.

Embodiment 2

Figure 6A:
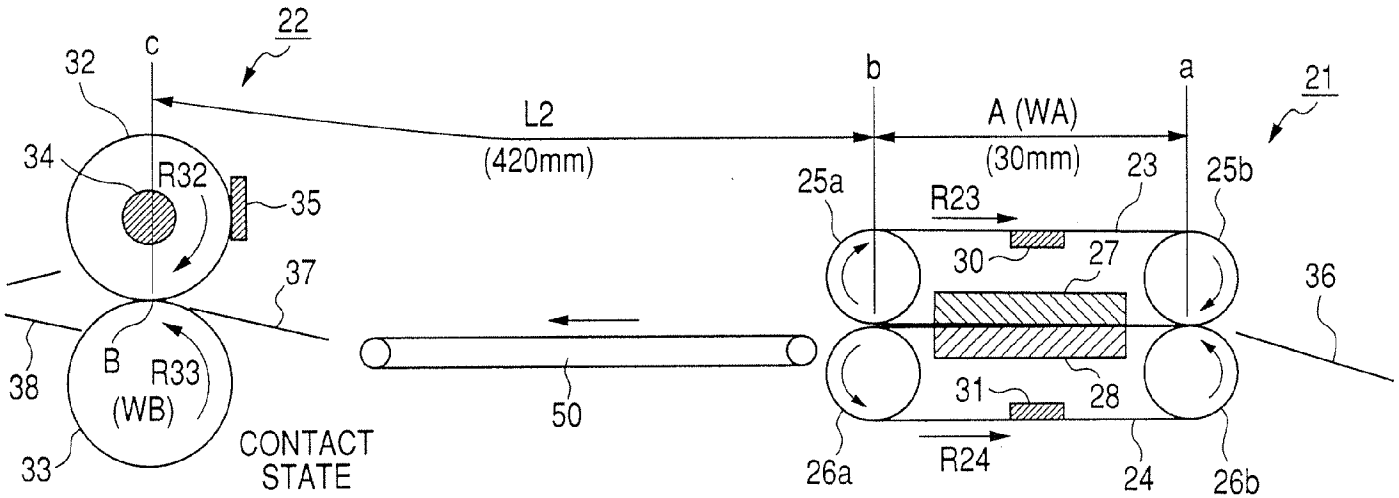
FIGS. 6A and 6B schematically show the construction of a fixing apparatus in Embodiment 2.
Figure 6B:
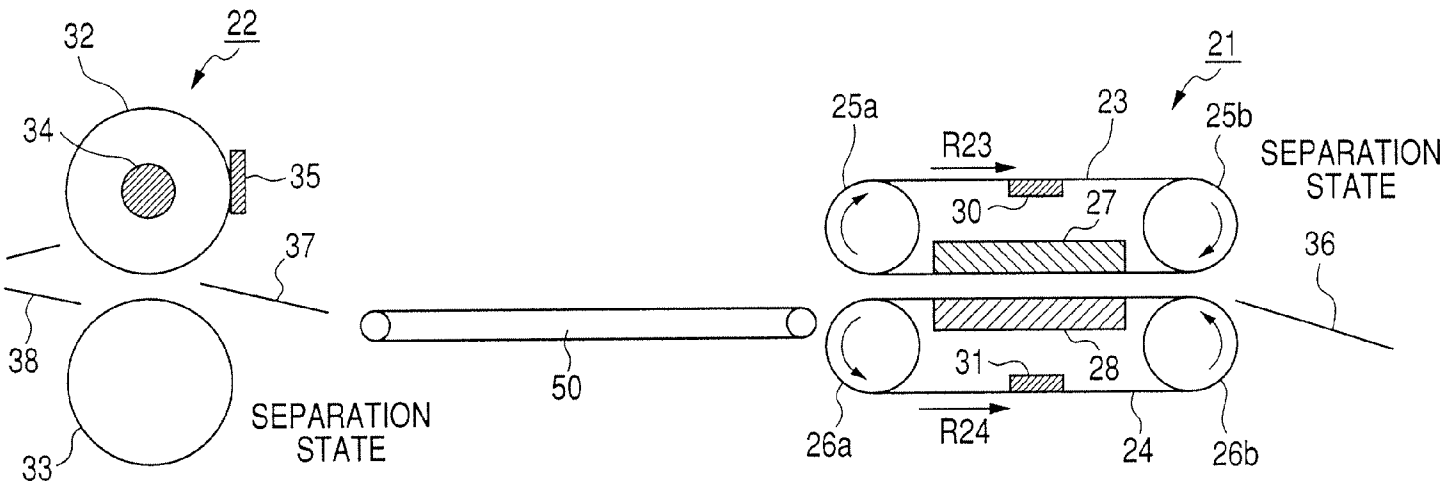

This embodiment is one in which as shown in FIG. 6A, the distance L2 between the upstream fixing device 21 and the downstream fixing device 22 (the length of the recording material conveying route) is such that the length in the conveying direction usable in the image forming apparatus is equal to or greater than the length of the largest recording material, and a conveying apparatus 50 such as a belt conveying apparatus for relay-conveying the recording material is disposed between the upstream fixing device 21 and the downstream fixing device 22. FIG. 6B shows a state in which during the standby, the fixing belt 23 and pressure belt 24 of the upstream fixing device 21 are switched to and held in a separation state and the fixing roller 32 and pressure roller 33 of the downstream fixing device are switched to an held in a separation state.

If the distance between the fixing devices 21 and 22 becomes long, various kinds of control can be effected between the fixing devices 21 and 22. The various kinds of control include, for example, correcting the curl of the recording material, providing a recording material conveying path for avoiding the downstream fixing device so as not to use the downstream fixing device 22 in accordance with the kind of paper, providing a mechanism for correcting the skew feeding of the recording material, etc. Further, if the distance between the fixing devices 21 and 22 is equal to or greater than the length of the largest recording material, it will lead to the advantage that the possibility of the fixing devices 21 and 22 pulling the recording material therebetween becomes null.

If as in the present embodiment, the plurality of fixing devices 21 and 22 differ in the fixing type from each other like the belt type or the roller type, the conveying speeds of the recording material in the respective fixing devices 21 and 22 will differ from each other. If the distance between the two fixing devices is equal to or greater than the length of the largest recording material, the fixing devices 21 and 22 will not pull the paper therebetween and therefore, the advantage of making the distance between the fixing devices great is great.

In the present embodiment, description will specifically be made of a case where the distance between the upstream fixing device 21 and the downstream fixing device 22 is 420 mm when the largest recording material usable in the image forming apparatus is of A3 size (210×420 mm).

Figure 7:
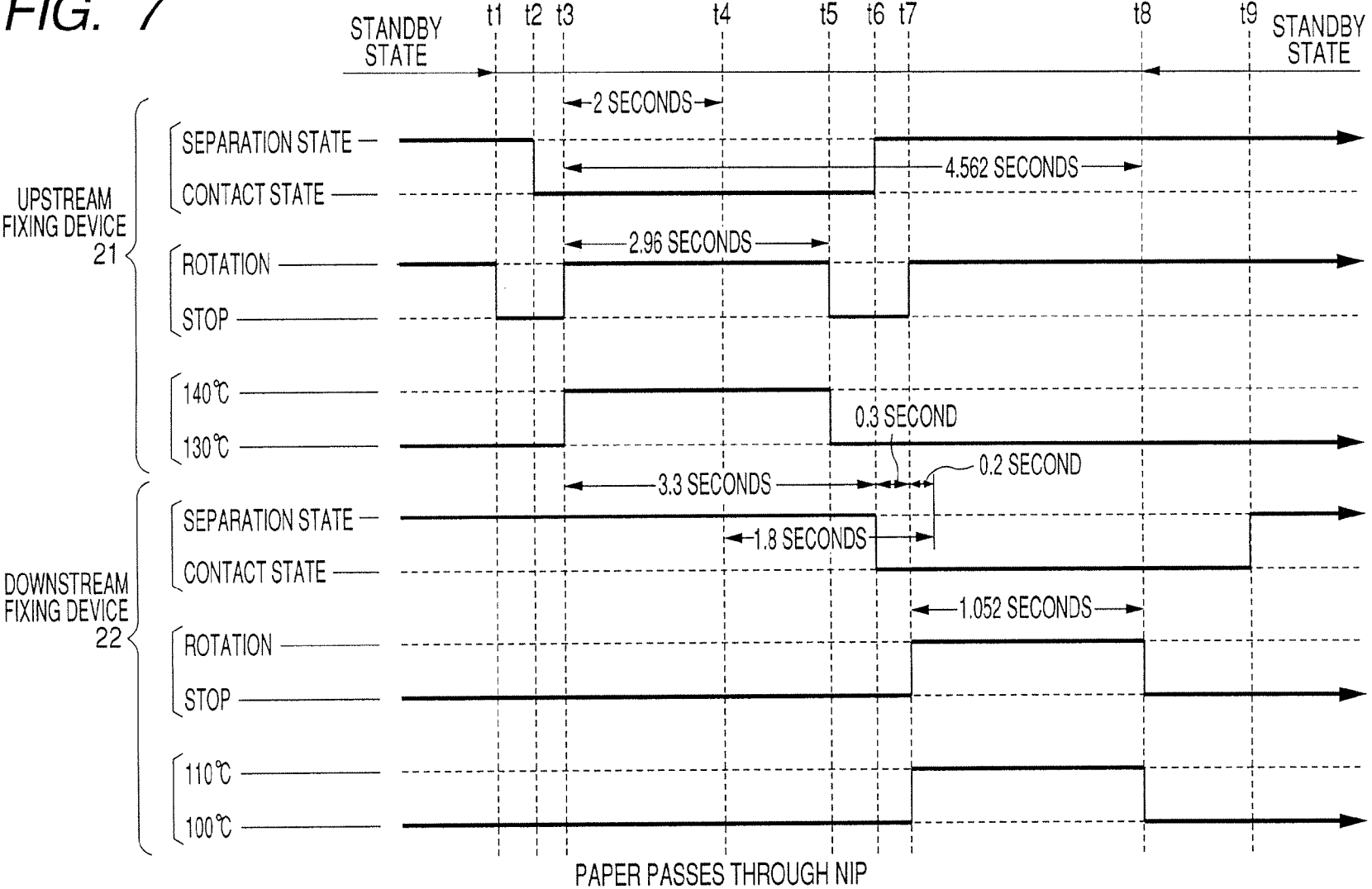
FIG. 7 is a timing chart of the fixing operation of Embodiment 2.

FIG. 7 shows a control timing chart of the upstream fixing device 21 and the downstream fixing device 22. The image forming apparatus and the fixing devices 21 and 22 are similar to those described in Embodiment 1 and therefore need not be described here. The recording material conveying speed of the conveying apparatus 50 is set to 250 mm/sec.

1) The Time when the Image Forming Operation is Started (the Time when the Image Heating Process is Started)

From the time (a point of time t1) when the image forming apparatus starts the image forming operation, in the upstream fixing device 21, the fixing belt 23 and the pressure belt 24 being rotated during the standby are stopped.

Thereafter, the fixing belt 23 and the pressure belt 24 are quickly brought into contact with each other (a point of time t2).

In the meantime, temperature adjustment is always effected on the basis of the detected value by the temperature sensors 30 and 31 so that the temperature of the fixing belt 23 and the pressure belt 24 may become 130° C.

Then, at a point of time t3, the rotation is started again and at the same time, the target temperature is raised to 140° C.

Once stopping the rotation is for the purpose of preventing the surfaces of the belt from being injured by a shift difference in the rotating speed if the fixing belt 23 and the pressure belt 24 are brought into contact with each other while being rotated.

At a point of time t4 after the lapse of 2 seconds from a point of time t3 at which the upstream fixing device 21 has started to be rotated, the recording material P being the unfixed toner image T thereon arrives at the nip A of the upstream fixing device 21.

On the other hand, the downstream fixing device 22 brings the fixing roller 32 and the pressure roller 33 into contact with each other at a point of time t6 after 3.3 seconds from the point of time t3 at which the upstream fixing device 21 has started to be rotated, and starts to be rotated at a point of time t7.

Simultaneously with the rotation, the target temperature of the fixing roller 32 is raised to 110° C.

The required time from the point of time t6 till the point of rotation time t7 is 0.3 second or so, and the distance from the exit portion "b" of the nip A of the upstream fixing device 21 to the entrance portion "c" of the nip B of the downstream fixing device 22 is 420 mm and therefore, the time from the point of time t4 at which the recording material P has arrived at the nip A of the upstream fixing device 21 until the recording material P arrives at the nip B of the downstream fixing device 21 is 1.8 second ((30 mm+420 mm)/250 mm/sec.=1.8 second).

Thus, after 0.2 second from the point of time t7 at which the downstream fixing device 22 has started to be rotated, the recording material P arrives at the nip B of the downstream fixing device 22.

2) The Time when the Image Forming Operation is Stopped (the Time when the Image Heating Process is Started)

Description will now be made of the time when the image forming apparatus stops the image forming operation.

The upstream fixing device 21 is quickly stopped from rotating at a point of time t5 immediately after the last recording material P in the image forming job has passed through the nip A. At the same time, the target temperature of the upstream fixing device 21 is lowered to 130° C.

At the point of time t6 after the rotation has been stopped, the fixing belt 23 and the pressure belt 24 are separated from each other, and at the point of time t7 thereafter, the two belts start to be rotated while remaining separated from each other, and shift is made to the standby state.

The downstream fixing device 22 is quickly stopped from rotating at a point of time t8 immediately after the last recording material P in the image forming job has passed through the nip B. Then, the target temperature of the fixing roller 32 is lowered to 100° C., and at a point of time t9 thereafter, the fixing roller 32 and the pressure roller 33 are separated from each other, and shift is made to the standby state.

Description will now be made of the rotating times of the fixing devices when in the above-described operation, an image is to be formed on a sheet of recording material of A4 size (having a length of 210 mm in the conveying direction).

First, the upstream fixing device 21 starts to be rotated, whereafter 2 seconds elapses, whereupon the recording material P bearing the unfixed toner image thereon arrives at the nip A of the upstream fixing device 21, and passes through this nip A, and immediately thereafter, the upstream fixing device 21 is stopped from rotating and therefore, the rotating time is 2.96 seconds ((30 mm+210 mm)/250 mm/sec.+2 sec.).

Next, the downstream fixing device 22 starts to be rotated and after 0.2 second, the recording material P arrives at the nip B of the downstream fixing device 22, and passes through the nip B, and immediately thereafter, the downstream fixing device 22 stops from rotating and therefore, the rotating time is 1.052 second ((3 mm+210 mm)/250 mm/sec.+0.2 sec.).

Assuming that the operations of the upstream fixing device 21 and the downstream fixing device 22 are started and stopped at the same times, both of the rotating times of the upstream fixing device 21 and the downstream fixing device 22 are 4.652 seconds ((30+420+3+210 mm)/250 mm/sec.+2 sec.).

Thus, according to the present embodiment, the rotating time of the upstream fixing device 21 has been shortened by about 36.4% and the rotating time of the downstream fixing device 22 has been shortened by about 77.4%. Such shortening of the rotating time of each fixing device means the extended life of the fixing device.

As described above, again in the present embodiment, an effect similar to that of Embodiment 1 can be obtained. In a construction wherein the distance between the fixing devices is longer as in the present embodiment, the rate at which the useless operating time of the fixing devices can be curtailed becomes greater and therefore, the degree of lengthening of the lives of the fixing devices is great.

Of course, the present invention is not restricted to the constructions of the above-described Embodiments 1 and 2, but various constructions are possible within the scope of the idea of the present invention.

This application claims priority from Japanese Patent Application No. 2004-168563 filed on Jun. 7, 2004, which is hereby incorporated by reference herein.

What is claimed is:

1. An image heating apparatus comprising:

a first pair of rotating members for heating an image on a recording material at a first nip portion formed therebetween;

a first contacting and separating device for contacting said first pair of rotating members with each other and separating said first pair of rotating members from each other;

a second pair of rotating members, provided downstream relative to said first pair of rotating members in a conveying direction of the recording material, for heating the image on the recording material, heated by said first pair of rotating members, at a second nip portion formed therebetween; and a second contacting and separating device for contacting with said second pair of rotating members each other and separating said second pair of rotating members each other;

a controller for starting a contacting operation of said first pair of rotating members earlier than a contacting operation of said second pair of rotating members at a start of an image heating process using said first pair of rotating members and said second pair of rotating members.

2. An image heating apparatus comprising:

a first image heating device for heating an image on a recording material at a first nip portion;

a second image heating device, provided downstream relative to said first image heating device in a conveying direction of the recording material, for heating the image on the recording material heated by said first image heating device at a second nip portion; and a controller for starting a temperature lowering operation of said first image heating device from a fixing temperature to a stand-by temperature earlier than a temperature lowering operation of said second image heating device from a fixing temperature to a stand-by temperature at an end of an image heating process using said first image heating device and said second image heating device.

* * * * *

UNITED STATES PATENT AND TRADEMARK OFFICE

CERTIFICATE OF CORRECTION

PATENT NO. : 7,317,881 B2
APPLICATION NO. : 11/776364
DATED : January 8, 2008
INVENTOR(S) : Yasuhiro Hayasahi It is certified that error appears in the above-identified patent and that said Letters Patent is hereby corrected as shown below:

COLUMN 4
Line 46, “image” should read --images--.

COLUMN 15
Line 45, “an” should read --and--.

Signed and Sealed this

Tenth Day of February, 2009

JOHN DOLL
*Acting Director of the United States Patent and Trademark Office*